US008232961B2

(12) United States Patent
Fan et al.

(10) Patent No.: US 8,232,961 B2
(45) Date of Patent: Jul. 31, 2012

(54) PIXEL DRIVING STRUCTURE OF DISPLAYING THREE COLORS OF PARTICLE DISPLAY AND ITS DISPLAYING COLORS METHOD

(75) Inventors: Shih-Kang Fan, Hsinchu (TW); Cheng-Pu Chiu, Taipei County (TW); Ching-Hsiang Hsu, Hsinchu (TW); Chi-Neng Mo, Taoyuan County (TW); Mei-Tsao Chiang, Taoyuan County (TW)

(73) Assignees: Chunghwa Picture Tubes, Ltd., Taoyuan (TW); National Chiao Tung University, Hsinchu (TW)

( * ) Notice: Subject to any disclaimer, the term of this patent is extended or adjusted under 35 U.S.C. 154(b) by 448 days.

(21) Appl. No.: 12/542,673

(22) Filed: Aug. 17, 2009

(65) Prior Publication Data

US 2010/0253704 A1 Oct. 7, 2010

(30) Foreign Application Priority Data

Apr. 7, 2009 (TW) ..... 98111434 A

(51) Int. Cl.
*G09G 3/34* (2006.01)

(52) U.S. Cl. ..... 345/107; 345/88; 345/89; 345/690

(58) Field of Classification Search ..... 345/87–100, 345/107, 204–215, 690
See application file for complete search history.

(56) References Cited

U.S. PATENT DOCUMENTS

| | | | | |
|---|---|---|---|---|
| 7,292,231 | B2 * | 11/2007 | Kodama et al. | 345/173 |
| 7,535,624 | B2 * | 5/2009 | Amundson et al. | 359/296 |
| 7,876,312 | B2 * | 1/2011 | Kodama et al. | 345/173 |
| 7,978,277 | B2 * | 7/2011 | Kimura | 349/48 |
| 8,054,279 | B2 * | 11/2011 | Umezaki et al. | 345/100 |

(Continued)

FOREIGN PATENT DOCUMENTS

CN 1522863 8/2004

(Continued)

OTHER PUBLICATIONS

"1st Office Action of China Counterpart Application", issued on Jun. 4, 2010, p. 1-p. 4, in which the listed references were cited.

(Continued)

*Primary Examiner* — Vijay Shankar
(74) *Attorney, Agent, or Firm* — Jianq Chyun IP Office

(57) ABSTRACT

A pixel driving structure of a particle display displaying three colors and a method for displaying colors thereof are provided. The pixel driving structure includes a first substrate; a first electrode layer disposed on a surface of the first substrate; a second substrate disposed opposite to the first substrate; a second electrode layer on the second substrate; a particle solution disposed between the first electrode layer and the second electrode layer and having a first color solution, a plurality of second color positive particles, and a plurality of third color negative particles; and an alternating/direct power supply connecting with the first and second electrode layers. A method for displaying color includes steps of applying an alternating voltage to display a first color; applying a first direct voltage to display a third color; and applying a second direct voltage to display a second color.

16 Claims, 4 Drawing Sheets

U.S. PATENT DOCUMENTS

| | | | | |
|---|---|---|---|---|
| 2002/0180688 | A1* | 12/2002 | Drzaic et al. | 345/107 |
| 2003/0034949 | A1* | 2/2003 | Albert et al. | 345/107 |
| 2004/0113884 | A1* | 6/2004 | Albert et al. | 345/107 |
| 2004/0155857 | A1* | 8/2004 | Duthaler et al. | 345/107 |
| 2006/0023296 | A1 | 2/2006 | Whitesides et al. | |
| 2006/0038772 | A1* | 2/2006 | Amundson et al. | 345/107 |
| 2006/0290616 | A1* | 12/2006 | Murayama et al. | 345/76 |
| 2008/0048970 | A1* | 2/2008 | Drzaic et al. | 345/107 |
| 2010/0060628 | A1* | 3/2010 | Lenssen et al. | 345/214 |

FOREIGN PATENT DOCUMENTS

| | | |
|---|---|---|
| CN | 1912726 | 2/2007 |
| CN | 201069507 | 6/2008 |
| JP | 2004522180 | 7/2004 |

OTHER PUBLICATIONS

"Office Action of Japan Counterpart Application", issued on May 8, 2012, p. 1-2, in which the listed reference was cited.

* cited by examiner

PIXEL DRIVING STRUCTURE OF DISPLAYING THREE COLORS OF PARTICLE DISPLAY AND ITS DISPLAYING COLORS METHOD

CROSS-REFERENCE TO RELATED APPLICATION

This application claims the priority benefit of Taiwan application serial no. 98111434, filed on Apr. 7, 2009. The entirety of the above-mentioned patent application is hereby incorporated by reference herein and made a part of specification.

BACKGROUND OF THE INVENTION

1. Field of the Invention

The present invention relates to a pixel driving structure of a particle display and a method for displaying colors thereof and more particularly, to a pixel driving structure of a particle display displaying three colors and a method for displaying colors thereof, which are applied to display colors in the field of electronic paper.

2. Description of Related Art

The electronic paper, as the name indicates, is a display resembling paper and is a new type of display with features of being light and thin like paper and capable of being rolled freely. The idea of electronic paper can be traced back to the 1970's (Wikipedia, 2007) and was developed by researchers at the research center of Xerox Corporation. in Palo Alto, Calif. in the U.S. The current display technologies of the electronic paper can be categorized into electrophoresis, micro-capsule, electronic powder, charged polymer particles, chloesteric liquid crystal, electrowetting, etc, wherein the electrophoretic electronic paper has been commercialized and there are also customized products of the micro-capsule electronic paper on the market.

Compared to conventional paper, the most striking features of the electronic paper are random access and repeatable use. Data content can be readily downloaded and updated through computer networks or wireless connection so that the data is more up-to-date. In contrast with a computer or PDA, the electronic paper has features such as light weight, thinness, capability of being moderately rolled and folded, portability, and low power consumption. The electronic paper consumes power only when the image changes and can continuously display an image when the power is switched off. Therefore, when displaying a considerable amount of text for reading, the electronic paper does not require power. Compared to display technology such as the Liquid Crystal Display, the electronic paper requires no backlight source, provides better readability in ambient light, has 180 degree view angle, and offers contrast superior to printed paper. Reading on the electronic paper is more comfortable and thus the electronic paper has strong potential for development.

The electronic paper includes a plurality of pixels. The color on the electronic paper is displayed by mixing the color generated by each pixel. Pixels of electronic papers manufactured by E Ink, Sipix, Bridgestone, etc. use particles carrying positive and negative charges of black and white and positive and negative terminals of electrodes are changed to attract corresponding charge particles to the electrodes to display black or white at each pixel or use particles carrying positive and negative charges of green and red and positive and negative terminals of electrodes are changed to attract corresponding charge particles to the electrodes to display green or red at each pixel. However, the pixels can not display three colors and the color diversity of images displayed by the electronic paper is thereby limited.

In light of the above-mentioned disadvantage of the pixel structure of the electronic paper, the present invention provides a pixel driving structure of a particle display displaying three colors and method for displaying colors thereof, which are capable of solving the problem that the pixel structure of the conventional electronic paper is capable of displaying two colors, resulting in limited color diversity of display images of the electronic paper.

SUMMARY OF THE INVENTION

The main purpose of the present invention lies in providing a pixel driving structure of a particle display displaying three colors and a method for displaying colors thereof, which enables the pixel driving structure of a particle display to display three colors so that the electronic paper has advantage of displaying images with abundant colors.

For the aforesaid purpose, the present invention provides a pixel driving structure of a particle display displaying three colors and a method for displaying colors thereof. The pixel driving structure of a particle display displaying three colors includes a first substrate; a first electrode layer disposed on a surface of the first substrate; a second substrate disposed opposite to the second substrate; a second electrode layer disposed on a surface of the second substrate; a particle solution disposed between the first electrode layer and the second electrode layer and having a first color solution, a plurality of second color positive particles and a plurality of third color negative particles; and an alternating/direct power supply with a first terminal electrically connecting to the first electrode layer and a second terminal electrically connecting to the second electrode layer. The method for displaying colors of the pixel driving structure of a particle display displaying three colors includes the steps of: applying an alternating voltage to a first electrode layer and a second electrode layer so that a plurality of second color positive particles and a plurality of third color negative particles are arranged in series and the pixel driving structure of a particle display displaying three colors displays a first color of a first color solution; applying a first direct voltage to the first electrode layer and the second electrode layer so that the plurality of third color negative particles are attracted to the first electrode layer and the plurality of second color positive particles are attracted to the second electrode layer and the pixel driving structure of a particle display displaying three colors displays the third color of the third color negative particles; and applying a second direct voltage to the first electrode layer and the second electrode layer so that the plurality of second color positive particles are attracted to the first electrode layer and the plurality of third color negative particles are attracted to the second electrode layer and the pixel driving structure of a particle display displaying three colors displays the second color of the second color positive particles.

In order to the make aforementioned and other objects, features and advantages of the present invention comprehensible, preferred embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
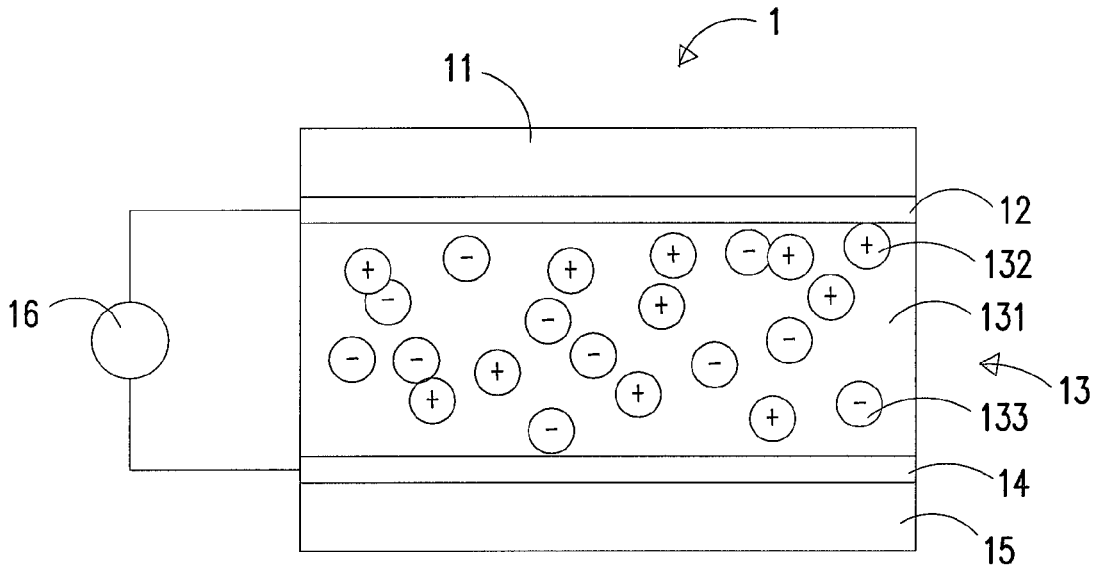
FIG. 1 is a schematic view of the pixel driving structure of a particle display displaying three colors according to an embodiment of the present invention.

The pixel driving structure 1 of a particle display displaying three colors (as shown in FIG. 1) includes a first substrate 11; a first electrode layer 12 disposed on a surface of the first substrate 11; a second substrate 15 disposed opposite to the first substrate; a second electrode layer 14 on a surface of the second substrate 15; a particle solution 13 disposed between the first electrode layer 12 and the second electrode 14 and having a first color solution 131, a plurality of second color positive particles 132, and a plurality of third color negative particles 133; and an alternating/direct power supply 16 with a first terminal electrically connecting to the first electrode layer 12 and a second terminal electrically connecting to the second electrode layer 14. The first electrode layer 12 and the second electrode layer 14 are both indium tin oxide (ITO) layers. The first color of the first color solution 131, the second color of the second color positive particles 132, and the third color of the third color negative particles 133 are respectively selected from one of red, green, and blue. In addition, the first color, the second color, and the third color are different. The first color solution 131 is a silicon oil solution having a first color, the second color positive particles 132 are carbon powders having a second color and carrying positive charge, and the third color negative particles 133 are carbon powders having a third color and carrying negative charge. Diameters of the carbon powders having the second color and carrying positive charge and the carbon powders having the third color and carrying negative charge are respectively in the range of 15~20 μm.

Figure 2:
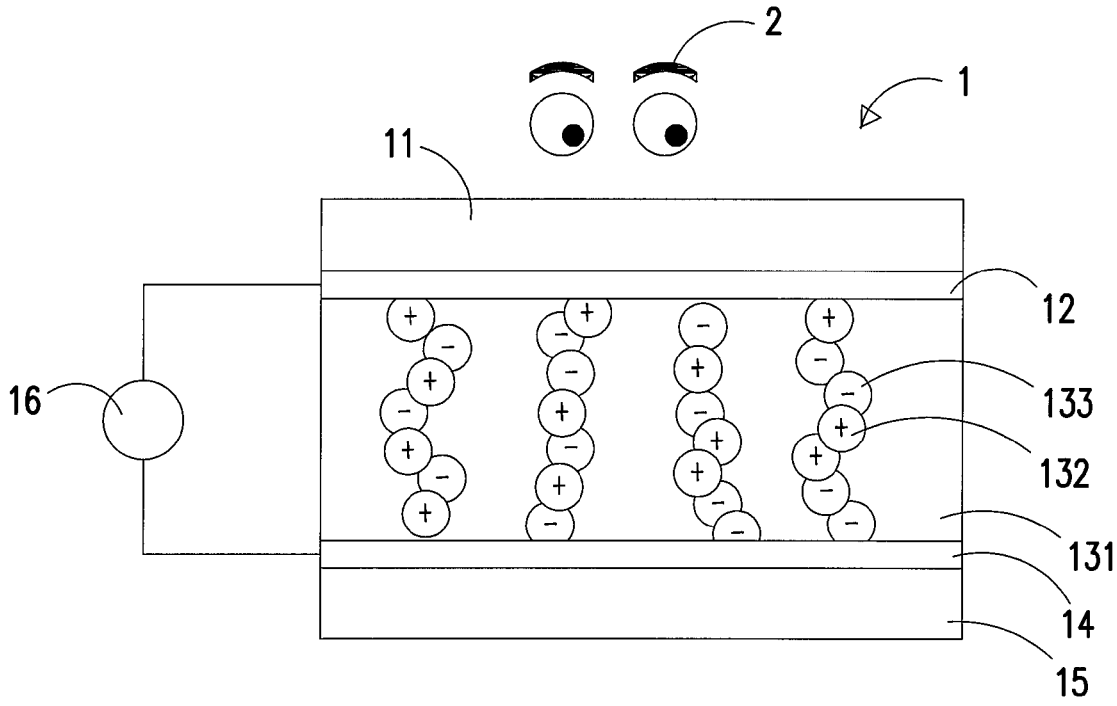
FIG. 2 is a schematic view (1) illustrating color display by the pixel driving structure of a particle display displaying three colors according to an embodiment of the present invention.
Figure 3:
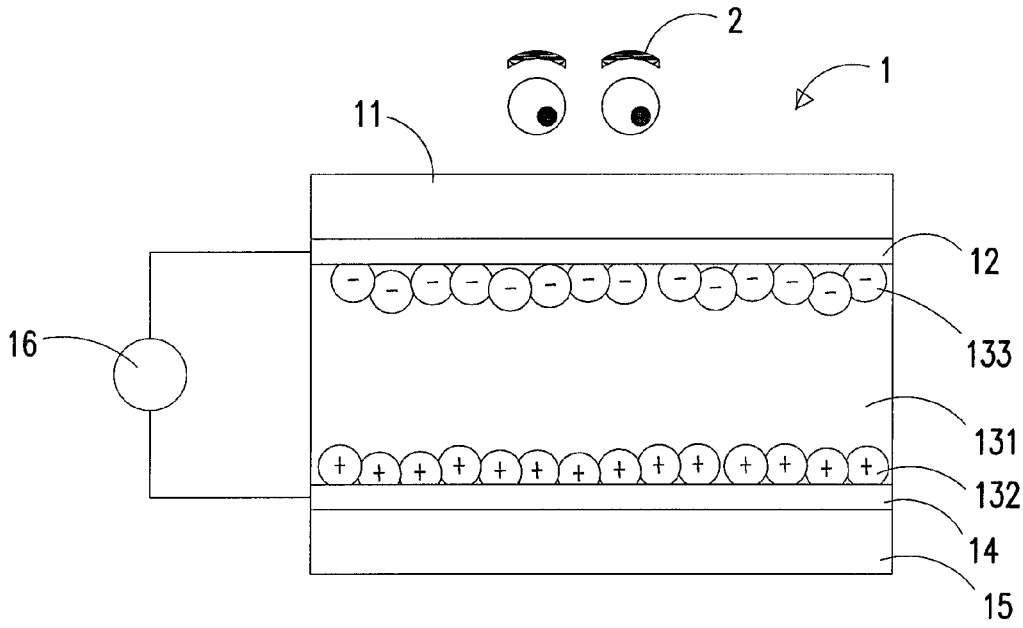
FIG. 3 is a schematic view (2) illustrating color display by the pixel driving structure of a particle display displaying three colors according to an embodiment of the present invention.
Figure 4:
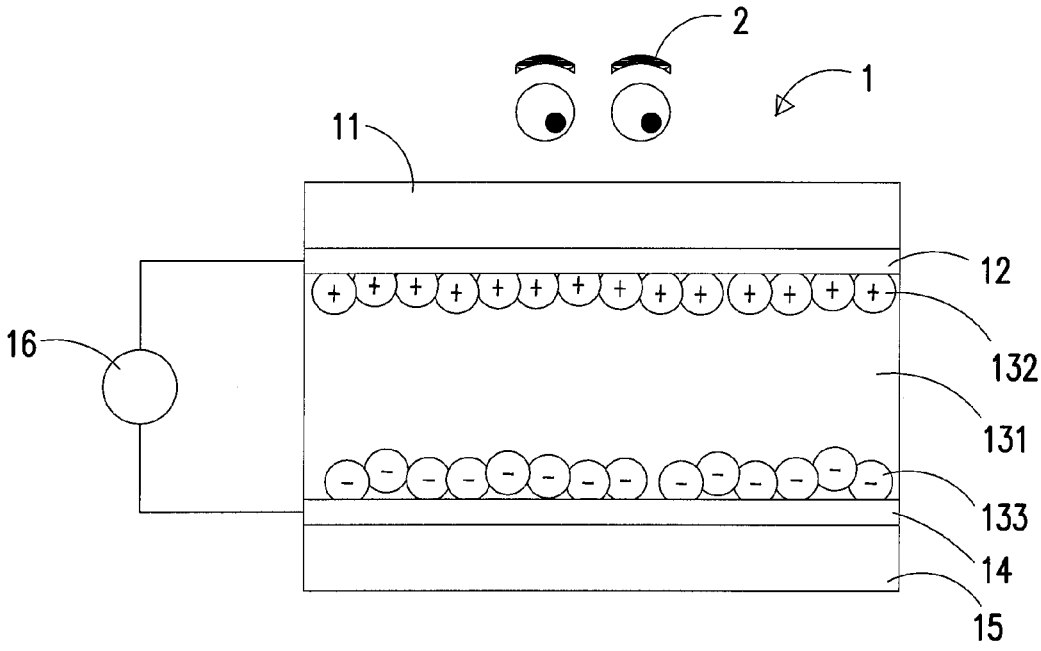
FIG. 4 is a schematic view (3) illustrating color display by the pixel driving structure of a particle display displaying three colors according to an embodiment of the present invention.

The method for displaying colors of the pixel driving structure of a particle display displaying three colors of the present invention is illustrated in FIGS. 2-4 and includes the following steps of:

Step 1: applying an alternating voltage to a first electrode layer 12 and a second electrode layer 14 so that the plurality of second color positive particles 132 and the plurality of third color negative particles 133 are arranged in series and the pixel driving structure 1 of the particle display displaying three colors displays the first color of the first color solution 131 (as shown in FIG. 2);

Step 2: applying a first direct voltage to the first electrode layer 12 and the second electrode layer 14, and positive charge is supplied to the first electrode layer 12 and negative charge is supplied to the second electrode layer 14 so that the plurality of third color negative particles 133 are attracted to the first electrode layer 12 and the plurality of second color positive particles 132 are attracted to the second electrode layer 14, and the pixel driving structure 1 of the particle display displaying three colors displays the third color of the third color negative particles 133 (as shown in FIG. 3); and Step 3: applying a second direct voltage to the first electrode layer 12 and the second electrode layer 14, and negative charge is supplied to the first electrode layer 12 and positive charge is supplied to the second electrode layer 14 so that the plurality of second color positive particles 132 are attracted to the first electrode layer 12 and the plurality of third color negative particles 133 are attracted to the second electrode layer 14, and the pixel driving structure 1 of the particle display displaying three colors displays the second color of the second color positive particles 132 (as shown in FIG. 4).

In the above steps 1-3, when the first color of the first color solution 131 is green, the second color of the second positive particle 132 is red, and the third color of the third negative particle 133 is blue, a viewer 2 sees that the pixel driving structure 1 of the particle display displaying three colors displays green in step S1; the pixel driving structure 1 of a particle display displaying three colors displays blue in step S2; and the pixel driving structure 1 of a particle display displaying three colors displays red in step S3.

The sequence of the steps 1-3 of the method for displaying colors of the pixel driving structure of the particle display displaying three colors is interchangeable. Therefore, the pixel driving structure of a particle display displaying three colors may also display green, blue, and red not according to any particular order.

In summary, the pixel driving structure of a particle display displaying three colors and a method for displaying colors thereof of the present invention are capable of displaying three colors. Furthermore, since the electronic paper comprises a plurality of pixels driving structures, the present invention enables the electronic paper to have advantage of color diversity when displaying images and resolves the disadvantage of a conventional electronic paper which is capable of displaying only two colors and thus has limited color variety.

The embodiments described hereinbefore are chosen and described in order to best explain the principles of the invention and its best mode practical application. It is not intended to be exhaustive to limit the invention to the precise form or to the exemplary embodiments disclosed. Hence, variations and modifications of the shape, structure, feature, and spirit described in the claims of the present invention are contemplated to fall within the scope of the present invention.

What is claimed is:

1. A method for displaying colors of a pixel driving structure of a particle display displaying three colors, the method comprising:

applying an alternating voltage to a first electrode layer and a second electrode layer so that a plurality of second color positive particles and a plurality of third color negative particles are arranged in series and the pixel driving structure of a particle display displaying three colors displays a first color of a first color solution;

applying a first direct voltage to the first electrode layer and the second electrode layer so that the plurality of third color negative particles are attracted to the first electrode layer and the plurality of second color positive particles are attracted to the second electrode layer and the pixel driving structure of a particle display displaying three colors displays a third color of the third color negative particles; and applying a second direct voltage to the first electrode layer and the second electrode layer so that the plurality of second color positive particles are attracted to the first electrode layer and the plurality of third color negative particles are attracted to the second electrode layer and the pixel driving structure of a particle display displaying three colors displays a second color of the second color positive particles.

2. The method according to claim 1, wherein the first color of the first color solution, the second color of the second color positive particles, and the third color of the third color negative particles are respectively selected from one of red, green, and blue, and the first color, the second color, and the third color are different.

3. The method according to claim 1, wherein the step of applying the first direct voltage comprises supplying positive charge to the first electrode layer and supplying negative charge to the second electrode layer.

4. The method according to claim 1, wherein the step of applying the second direct voltage comprises supplying negative charge to the first electrode layer and supplying positive charge to the second electrode layer.

5. The method according to claim 1, wherein the first electrode layer and the second electrode layer are indium tin oxide (ITO) layers.

6. The method according to claim 1, wherein the first color solution is a silicon oil solution of a first color.

7. The method according to claim 1, wherein the second color positive particles are carbon powders having a second color and carrying positive charge.

8. The method according to claim 1, wherein the third color negative particles are carbon powders having a third color and carrying negative charge.

9. The method according to claim 7, wherein diameter of the carbon powders having the second color and carrying positive charge is in the range of 15~20 μm.

10. The method according to claim 8, wherein diameter the carbon powders having the third color and carrying negative charge is in the range of 15~20 μm.

11. A pixel driving structure of a particle display displaying three colors, the pixel driving structure comprising:

a first substrate;

a first electrode layer disposed on a surface of the first substrate;

a second substrate disposed opposite to the first substrate;

a second electrode layer disposed on a surface of the second substrate;

a particle solution disposed between the first electrode layer and the second electrode layer, and having a first color solution, a plurality of second color positive particles and a plurality of third color negative particles, wherein the second color positive particles are carbon powders having a second color and carrying positive charge, and diameter of the carbon powders having the second color and carrying positive charge is in the range of 15~20 μm; and an alternating/direct power supply having a first terminal electrically connecting to the first electrode layer and a second terminal electrically connecting to the second electrode layer.

12. The pixel driving structure according to claim 11, wherein the first electrode layer and the second electrode layer are indium tin oxide (ITO) layers.

13. The pixel driving structure according to claim 11, wherein a first color of the first color solution, a second color of the second color positive particles, and a third color of the third color negative particles are respectively selected from one of red, green, and blue, and the first color, the second color, and the third color are different.

14. The pixel driving structure according to claim 11, wherein the first color solution is a silicon oil solution having a first color.

15. The pixel driving structure according to claim 11, wherein the third color negative particles are carbon powders having a third color and carrying negative charge.

16. The pixel driving structure according to claim 15, wherein diameter of the carbon powders having the third color and carrying negative charge is in the range of 15~20 μm.

* * * * *